US005994657A

United States Patent [19]

Maier et al.

[11] Patent Number: 5,994,657

[45] Date of Patent: Nov. 30, 1999

[54] DEVICE AND METHOD FOR SORTING MAILED PIECES

[75] Inventors: Wilhelm Maier, Wettingen; Jean-Claude Oppliger, Niederhasli, both of Switzerland

[73] Assignee: GRAPHA-Holding AG, Hergiswil, Switzerland

[21] Appl. No.: 08/900,451

[22] Filed: Jul. 25, 1997

[30] Foreign Application Priority Data

Jul. 26, 1996 [CH] Switzerland ..... 1866/96

[51] Int. Cl.[6] ..... B07C 5/00

[52] U.S. Cl. ..... 209/584; 209/698; 209/900; 209/919; 198/370.05; 198/704

[58] Field of Search ..... 209/552, 584, 209/655, 698, 900, 919; 198/370.05, 704

[56] References Cited

U.S. PATENT DOCUMENTS

| | | | |
|---|---|---|---|
| 3,645,378 | 2/1972 | Jakubowski | 198/349 |
| 4,688,678 | 8/1987 | Zue et al. | 209/900 X |
| 4,895,242 | 1/1990 | Michel | 198/704 X |
| 5,042,667 | 8/1991 | Keough | 209/584 X |
| 5,147,048 | 9/1992 | Signoretto | 209/698 |

FOREIGN PATENT DOCUMENTS

| | | | |
|---|---|---|---|
| 0476984 | 3/1992 | European Pat. Off. . | |
| 0608161 | 7/1994 | European Pat. Off. . | |
| 1623798 | 1/1991 | U.S.S.R. | 209/584 |
| 1719105 | 3/1992 | U.S.S.R. | 209/584 |
| 95/17267 | 6/1995 | WIPO . | |

*Primary Examiner*—Tuan N. Nguyen
*Attorney, Agent, or Firm*—Venable; Robert Kinberg; Catherine M. Voorhees

[57] ABSTRACT

A device and method for sorting flat mailed pieces. The mailed pieces are individually transferred to conveying cells which can be conveyed one behind the other along a conveying path and are delivered to receptacles which are arranged along the conveying path. The mailed pieces are transferred by a transfer device to the conveying cells. The main planes of the mailed pieces (14) are oriented essentially vertically. The receptacles for the mailed pieces conveyed by the conveying cells are determined on the basis of a preset sequence of all possible mailing addresses, the mailing addresses of all mailed piece transferred to the conveying cells, and the association data representing the association between the individual mailed pieces and the conveying cells.

1 Claim, 1 Drawing Sheet

DEVICE AND METHOD FOR SORTING MAILED PIECES

CROSS-REFERENCE TO RELATED APPLICATION

This application claims the priority of Swiss Patent Application No. 1996 1866/96 filed Jul. 26, 1997, the rights of priority of which are claimed for the instant application and the subject matter of which is incorporated herein by reference.

BACKGROUND OF THE INVENTION

The present invention relates to a device for placing flat mailed pieces, which are delivered in an arbitrary sequence, into a sequence arranged in accordance with their shipping addresses, which can be stored in the device for a plurality of possible mailing addresses, with a number of conveying cells, which can be conveyed one behind the other along a conveying path of an essentially horizontal transfer section past a transfer device, with a feed opening provided in the transfer device, from which the mailed pieces are sequentially transferred in their arbitrary sequence in an alignment of their main plane, which is essentially parallel with the transfer direction, to the conveying cells in the transfer section along a transfer device directed to the insertion opening of the conveying cells, with a control device, which detects the association data representing the association between the individual conveying cells and the mailed pieces which were transferred to them and with a number of receptacles disposed one behind the other along a delivery section of the conveying path, to which the mailed pieces transferred to the conveying cells are selectively delivered in the sorted sequence in accordance with delivery signals generated by the control device on the basis of the association data, as well as a method which can be executed by means of it.

Known devices of this type are used in post offices for sorting mailed pieces in accordance with delivery areas. To this end, the mailed pieces are individually pulled in the horizontal direction out of a stack of mailed pieces which stand upright and are transported to a vertical conveyor, by which they are then inserted into the conveying cells from above in the transfer section. Generally, conveying cells fixed on a conveyor chain are used, which are disposed above the conveyor chain in the area of the transfer section and have an upper insertion opening for the mailed pieces. After the transfer section and following the closing of the insertion opening with a cover element, which can be changed between an opening position and a closing position, the conveying cells filled with the mailed pieces are switched into a position where they are suspended below the conveyor chain.

The association between the conveying cells and the mailed pieces transferred to them is detected during the transfer. Furthermore, the mailing addresses of the mailed pieces are usually detected during the transport to the vertical conveyor and stored in the control device. Based on this information, it is possible to generate a delivery signal for each conveying cell in the control device, by means of which the change of the cover element from the closed position to the open position is caused when the conveying cell passes the receptacle of a number of receptacles arranged one behind the other along a transfer section disposed under the collection path, which is associated with the delivery area for which the respective mailed piece. These mailed pieces then fall automatically out of the conveying cell for delivery to this receptacle.

The operation of such devices requires buildings with large spaces as well as high operating and associated costs, because the formation of stacks of the sorted material can only be done by manual night work.

It is the object of the invention to make a device of the type mentioned at the outset available, which requires less space and can be optimized in accordance with the purpose.

This object is attained in accordance with the invention in that the transfer device essentially extends horizontally and the main plane of the mailed pieces is essentially vertically oriented.

With this choice of the transfer device and orientation of the mailed pieces it is possible to transfer the mailed pieces, which are individually pulled out of a stack of upright standing mailed pieces, directly to the conveying cells without a previous transfer to a vertical conveyor, because of which shorter conveying paths are created and less space is required.

In the device in accordance with the invention, the feed device used for pulling the mailed pieces out of the stack of mailed pieces and for transferring the pulled-off mailed pieces into the conveyor cells can be constituted in a particularly simple manner in the form of a rotating conveyor belt, whose main plane is essentially oriented vertically.

An automatic reading device is usefully associated with the transfer device, by means of which the mailing addresses are read and supplied to the control device.

A particularly compact structure of the device in accordance with the invention is achieved if the conveying cells can be conveyed along a closed conveyor loop, because in that case they can be conveyed along the same conveying path for the transfer of the mailed pieces to the conveying cells and for delivering the mailed pieces to the receptacles. Furthermore, in this case the conveying cells can be conveyed in a constant direction, which can be achieved by means of a particularly simple drive.

A particularly dependable delivery of the mailed pieces to the receptacles is achieved if the delivery section extends essentially in a straight line, because then no transverse forces (centrifugal forces) act on the mailed pieces during the delivery.

For delivering the mailed pieces to the receptacles, the conveying cells can have a wall area which, responding to the appropriate delivery signals, can be changed between a conveying position and a release position, which permits the delivery of the mailed pieces. By means of this it is possible to prevent an unintentional delivery of the mailed pieces, and the operational dependability of the device can be increased.

The space required for the device in accordance with the invention is particularly small if the delivery section extends above the receptacles. With this arrangement the displaceable wall area is usefully disposed on the bottom of the conveying cells. The mailed pieces then fall automatically into the corresponding receptacle under the effects of gravity when the displaceable wall area is displaced into the release position.

The operational dependability of the device in accordance with the invention can be further increased if, in an area located outside the transfer section, in particular in a curved area of the conveying path, the insertion openings of the conveying cells are covered by a fixed covering element, by means of which it is possible to prevent the mailed pieces from being tossed out of the conveying elements by the effects of gravity.

In view of the removal of the mailed pieces, which were sorted by means of the device in accordance with the invention, it is useful that the receptacles are formed from dividing elements, by means of which the individual receptacles are separated from each other, and a removal element, which can be displaced between a receiving position and a removal position and is common to a number of receptacles, wherein the mailed pieces transferred to the receptacles are separated by the dividing elements in the removal position of the removal element. Receptacles designed in this way allow the removal of the mailed pieces from several receptacles without being hampered by the dividing elements required for the previous sorting.

The conveying cells of the device in accordance with the invention can be constructed particularly simply if they have two boundary walls, which are located opposite each other and are essentially vertically oriented in the transfer section, and the insertion openings are embodied between essentially vertically extending free edges of these boundary walls.

The mailed pieces, which were presorted by means of the above explained device, are customarily taken by the postal carriers responsible for the individual delivery areas and are sorted prior to delivery in accordance with the sequence of the individual mailing addresses on the route which must be travelled for delivery. This later sorting of the mailed pieces is very time-consuming and therefore results in a considerable delay of the delivery of the mailed pieces.

BRIEF DESCRIPTION OF THE INVENTION

The above drawbacks are avoided by the device in accordance with the invention if the sequence of all possible mailing addresses on the route to be travelled for delivery in a delivery area is fixed as a sorted sequence in the device, and the later sorting of the mailed pieces, which had previously been presorted in accordance with the individual delivery areas, is performed by means of a device in accordance with the invention.

In view of the multitude of possible mailing addresses in a delivery area it has been shown to be particularly practical if for each mailed piece transferred to the conveying cells it is possible to determine by means of the control device and on the basis of the preset data and the mailing addresses of all mailed pieces transferred to the conveying cells one of the receptacles, whose position in the sequence of the receptacles along the delivery section corresponds to the position of the mailing address of the respective mailed piece in the sorted sequence of the mailing addresses of all mailed pieces transferred to the conveying elements.

By taking into account the mailing addresses of all mailed pieces transferred to the conveying cells when determining the receptacles for the individual mailed pieces, it is achieved that the number of receptacles required in one work cycle of the device in accordance with the invention for sorting is not determined by the total number of all mailing addresses of a delivery area, but by the generally considerably lower number of available conveying cells, since it is not necessary to make a receptacle available for each individual possible mailing address if the mailing addresses of all mailed pieces transferred to the conveying cells are taken into consideration.

This advantage will be explained by way of the following example:

If among the mailed pieces to be sorted in one work cycle of the device in accordance with the invention there is a mailed piece for the tenth possible mailing address in the sorted sequence, and if in this work cycle no mailed piece for the first nine possible mailing addresses needs to be sorted, the tenth mailing address is in first place in the ordered sequence among the mailing addresses of all mailed pieces transferred to the conveyor cells in this work cycle, and the mailed piece bearing it can be deposited in the receptacle which is first in the conveying direction. In this case no receptacle is required for the first nine permissible mailing addresses.

If the number of mailed pieces presorted for a delivery area exceeds the number of the conveying cells of the device in accordance with the invention, it is possible to first sort the mailed pieces by means of the device in accordance with the invention in several work cycles, and thereafter to further process them in a further sorting process for the sorted mailed pieces which were sorted in the individual work cycles in accordance with the ordered sequence.

As explained above, the device in accordance with the invention permits the execution of a method for transferring mailed pieces arranged in an arbitrary sequence into a sequence ordered by their mailing addresses and fixed for a multitude of possible mailing addresses, wherein the mailed pieces are individually transferred in their arbitrary sequence to respectively one conveying cell of a number of conveying cells which can be conveyed one behind the other along a conveying path, wherein association data representing the association between each conveying cell and the mailed piece transferred to it are determined, and the mailed pieces, responding to delivery signals generated on the basis of the association data, are selectively delivered in accordance with the ordered sequence to respectively one receptacle of a number of receptacles disposed one behind the other along a delivery section of the conveying path, which is distinguished in that a receptacle is determined on the basis of the ordered sequence of the mailing addresses of all mailed pieces transferred to the conveying cells and of the association data for each of the mailed pieces transferred to the conveying cells, whose position in the sequence of the receptacles along the delivery sections corresponds to the position of the mailing address of the respective mailed piece in the ordered sequence of the mailing addresses of all mailed pieces transferred to the conveying cells.

This process is not bound to the nature of the products, i.e. rigid as well as flexible products can be processed.

In connection with the embodiment of the method in accordance with the invention with a device having conveying cells, which can be conveyed along a closed conveying loop, it is particularly practical if the mailed pieces are transferred to the conveying cells during a first circulation of the conveying cells along the conveying loop, that then the corresponding receptacle is determined for each of the mailed pieces, and the mailed pieces are thereafter delivered to the receptacles during a second circulation of the conveying cells along the conveying loop.

DETAILED DESCRIPTION OF THE PREFERRED EMBODIMENTS

Figure 2:
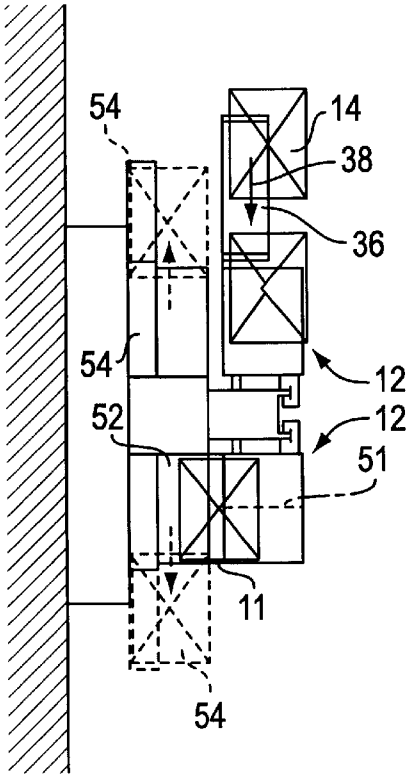
FIG. 2 is a sectional view along the line A—A in FIG. 1 of the device represented in FIG. 1.
Figure 1:
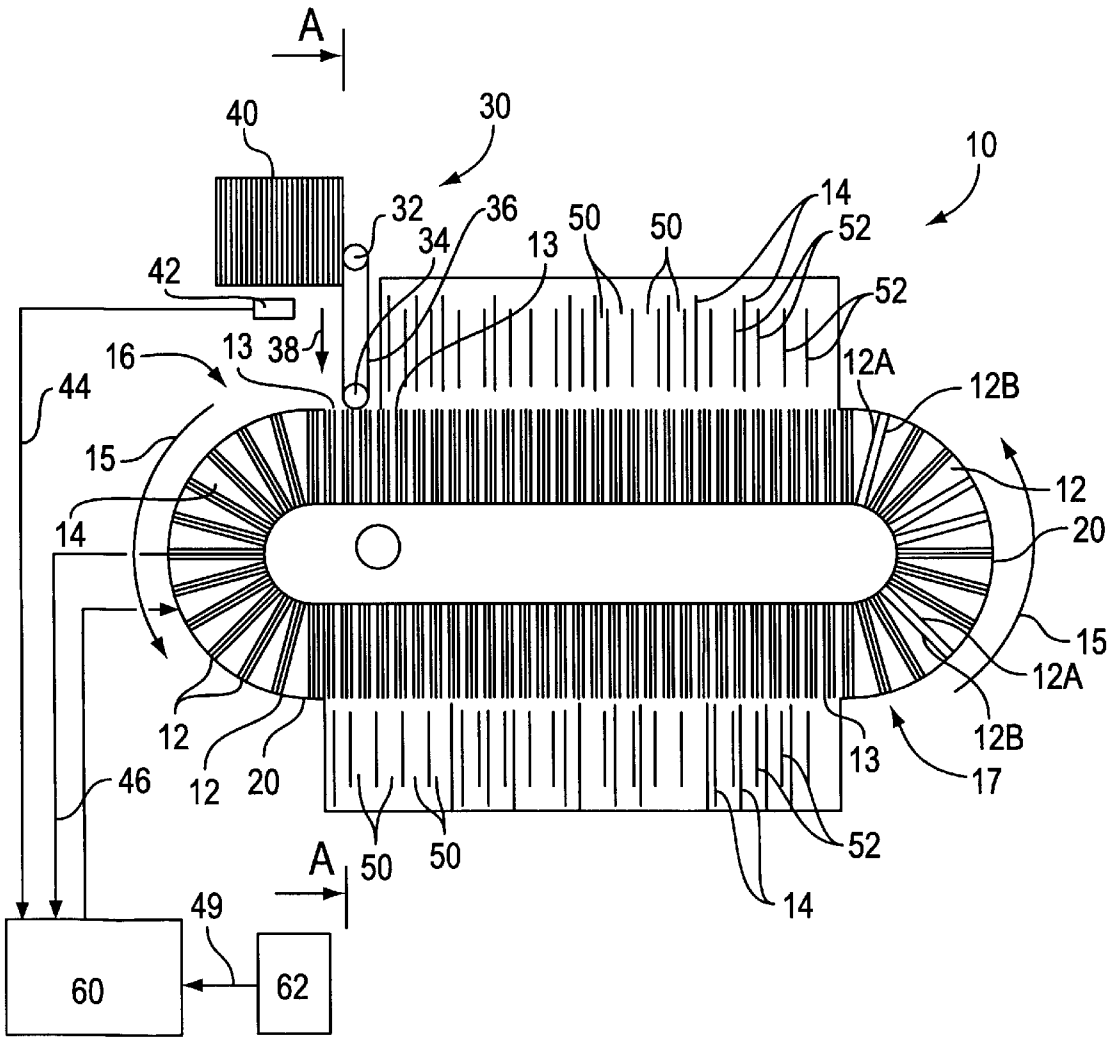
FIG. 1 is a schematic top view on a device in accordance with the invention.

The device shown in the drawings has a carrousel-like conveyor device 10 with a number of conveying cells 12 which can be conveyed along a closed conveying loop. The conveying loop has two sections 18 and 19 which extend in a straight line in a horizontal plane and which are connected by means of two semicircular sections 16 and 17, extending in the same horizontal plane. A number of receptacles in the form of receptacles 50 are arranged one behind the other along the sections 18 and 19 extending in a straight line. The conveying cells 12 can be driven, running in the direction indicated by the arrows 15, circulating along the conveying loop. The conveying cells 12 respectively have two boundary walls 12*a,* 12*b,* which are located opposite each other and are vertically oriented, between whose outer, free and vertically extending edges an insertion opening 13 for flat mailed pieces 14 is formed in the shape of a slit.

A mailed piece transfer device 30 is provided at the end of the straight extending section 18 of the conveying loop which is in back in the conveying direction. This mailed piece transfer device 30 has a conveyor belt 36 running around two vertically extending rollers 32 and 34 whose main plane is vertically oriented and with which flat mailed pieces 14 can be individually pulled in an arbitrary sequence off a stack 40 of upright standing mailed pieces and are, as indicated by the arrow 38, transferred in the horizontal direction in an upright position, i.e. in a position in which their main planes are essentially vertically oriented, through the insertion openings 13 to the conveying cells 12. In the embodiment shown in the drawings, mainly rectangular letters 14 are transferred to the conveying cells 12 in such a way that during the transfer their shorter side edges extend essentially in the vertical direction approximately parallel with the insertion opening 13.

During the transport by the conveyor belt 36, the mailing addresses of the mailed pieces 14 are automatically read by a reading device 42 and are entered via a signal line 44 into a control device 60. A signal which identifies the conveying cell 12, to which the mailed piece whose mailing address had been read by the reading device 42 is delivered, is simultaneously entered into the control device 60 via a signal line 46. The association data constituting the association between each conveying cell and the mailing address of the mailed piece transferred to it are determined from these.

After their transfer to the conveying cells 12, the mailed pieces 14 pass through the semicircular section 16 of the conveying loop. In the course of this, the insertion openings 13 of the conveying cells 12 are covered by a covering element 20. In this way, the mailed pieces 14 are prevented from being tossed out of the conveying cells 14 by the centrifugal force acting in the semicircular section 16. Thereafter the conveying cells pass through the straight extending section 19, the semicircular section 16, in which the tossing out of the mailed pieces 14 through the insertion opening 13 is again prevented by a covering element 20, and thereafter reach the straight extending section 18.

In the course of such a complete circulation through the conveying loop, mailed pieces 14 can be transferred to all conveying cells 12 by means of the transfer device 30. In the process the mailing addresses of all mailed pieces 14 transferred to the conveying cells 12 are automatically read with the reading device 42 and entered via the signal line 44 into the control device 60. In addition, the control device 60 is provided via the signal line 46 with a signal for each transferred mailed piece 14, which identifies the conveying cell to which the respective mailed piece 14 was transferred.

From the data received in this manner, the association data representing the association between each conveying cell 12 and the mailing address of the mailed piece 14 transferred to it are determined in the control device 60. Finally, preset data from a memory unit 62 are also entered into the control device 60 via a signal line 49, which represent an ordered sequence of all possible mailing addresses, i.e. which can be sorted by the device. On the basis of these data, the control device 60 makes a determination as to which one of the bins or receptacles 50 arranged along the straight extending sections 18 and 19 the mailed pieces 14 transferred to the conveying cells 12 are to be delivered. To this end, a receptacle is determined in the control device for each mailed piece transferred to the conveying cell on the basis of the preset data, and of the mailing addresses of all mailed pieces transferred to the conveying device, whose position in the sequence of the receptacles along the straight extending sections 18 and 19, i.e. along the delivery sections of the conveying loop, corresponds to the position of the mailing address of the respective mailed piece in the ordered sequence of all mailed pieces transferred to the conveying cells.

In view of the foregoing, the receptacle which is the first in the conveying direction 15 of the receptacles 50 arranged along the straight extending section 19, is associated with the mailed piece whose mailing address is in first place in the ordered sequence among all the mailed pieces transferred to the conveying cells 12. This similarly applies to the mailed pieces, whose mailing addresses are in the second, third, etc. place in the ordered sequence of all mailed pieces. Once all receptacles 50 arranged along the straight extending section 19 have been associated with a mailed piece transferred to the conveying cells 12, the receptacles 50 of the straight extending section 18 are associated next in the sequence indicated by the conveying direction with the further mailed pieces, whose mailing addresses are at the respective positions in the ordered sequence of all mailed pieces. In this way, a receptacle 50 is determined for each mailed piece 14 transferred to the conveying cells 12 during the first circulation through the conveying loop.

During the next circulation of the conveying cells 12 through the conveying loop, a delivery signal is generated by the control device 60 for each conveying cell 12 on the basis of the bins previously determined for the individual mailed pieces and of the association data when the respective conveying cell passes the bin for the mailed piece which had been transferred to it, and is applied to the conveyor device 10. To this end, the control device 60 determines at all times the position of all conveying cells 12 in respect to all receptacles 50. It is sufficient for this purpose that the position of one conveying cell 12 in respect to the receptacles 50 is continuously monitored by the control device 60, and the positions of the other conveying cells 12 in respect to the receptacles 50 are determined on the basis of the position of the one conveying cell determined in this way and a of predetermined positional relationship of the conveying cells with each other.

The cell bottom 11 (compare FIG. 2) of the respective conveying cell 12 is displaced in response to the delivery signal into a release position, so that the mailed piece 14 which had been transferred to it can fall in the direction indicated by the arrow 51 in FIG. 2 downward into the corresponding receptacle 50. In this way all mailed pieces 14 transferred in the course of the first circulation to the conveying cells 12 are delivered to the corresponding bins during the second circulation. Following this the mailed pieces 14 are ordered in the receptacle 50 in accordance with the preset sequence.

The receptacles 50 are composed of dividing elements 52 which are fixed in place on the conveyor device 10 and by which the individual bins are separated from each other, and by drawers 54, disposed under them and commonly associated with a number of receptacles (see FIG. 2). The drawers 54 can be moved from a receiving position, drawn in solid lines in FIG. 2, into a removal position, drawn in dashed lines in FIG. 2, for removing the mailed pieces 14 from the receptacles 50. In the removal position the mailed pieces 14 are separated from the dividing elements 52 required for sorting, so that they can be taken out of the drawers 54 without being hampered by these dividing elements 52.

The invention is not limited to the exemplary embodiment explained above. For example, it is also conceivable to arrange the conveying path in several planes above each other, or to arrange the mailed pieces in accordance with delivery areas.

We claim:

1. A method for transferring mailed pieces arranged in an arbitrary sequence into a sequence ordered by their mailing addresses and fixed for a multitude of possible mailing addresses comprising the steps of:

individually transferring the mailed pieces in an arbitrary sequence to a respective conveying cell of a number of conveying cells, said conveying cells being conveyed one behind the other along a conveying path in a closed conveying loop;

determining association data representing an association between each conveying cell and the mailed piece transferred to the respective conveying cell;

selectively delivering the mailed pieces in response to delivery signals generated on the basis of the association data so that the mailed pieces are delivered in accordance with the ordered sequence to respectively one receptacle of a number of receptacles disposed one behind the other along a delivery section of the conveying path; and determining the respective receptacle on the basis of the ordered sequence of the mailing addresses of all the mailed pieces transferred to the conveying cells and of the association data for each of the mailed pieces transferred to the conveying cells, the position of the respective receptacle in the sequence of receptacles along the delivery section corresponding to the position of the mailing address of the respective mailed piece in the ordered sequence of the mailing addresses of all mailed pieces transferred to the conveying cells, wherein the mailed pieces are transferred to the conveying cells during a first circulation of the conveying cells around the conveying loop, then the respective receptacle is determined for each transferred mailed piece, and the mailed pieces are delivered to the receptacles during a second circulation of the conveying cells around the conveying loop.

* * * * *